United States Patent [19]

Kydonieus

[11] Patent Number: 4,779,734

[45] Date of Patent: Oct. 25, 1988

[54] DEVICE FOR STORING AND SHIPPING BLISTER PACK ARTICLES

[75] Inventor: Christos Kydonieus, Kendall Park, N.J.

[73] Assignee: Revlon, Inc., New York, N.Y.

[21] Appl. No.: 929,536

[22] Filed: Nov. 12, 1986

[51] Int. Cl.[4] ..... B65D 73/00

[52] U.S. Cl. ..... 206/470; 206/45.31; 206/467

[58] Field of Search ..... 206/461, 463, 467, 470, 206/45.31, 468; 220/4 E, 40, 190

[56] References Cited

U.S. PATENT DOCUMENTS

| | | | |
|---|---|---|---|
| 3,161,288 | 12/1964 | Wagner | 206/45.31 |
| 3,173,540 | 3/1965 | Lapides | 206/78 |
| 3,179,246 | 4/1965 | Rosenburg, Jr. | 206/78 |
| 3,185,295 | 5/1965 | Crane, Jr. | 206/45.31 |
| 3,192,681 | 7/1965 | Greenbaum | 53/30 |
| 3,298,515 | 1/1967 | Watts, Jr. | 206/78 |
| 3,407,928 | 10/1968 | Watts, Jr. | 206/78 |
| 3,424,380 | 1/1969 | Curran | 239/60 |
| 3,497,059 | 2/1970 | Watts, Jr. | 206/78 |
| 3,498,446 | 3/1970 | Lafreniere | 206/45.34 |
| 3,616,989 | 9/1969 | Martinek | 229/190 |
| 3,645,384 | 2/1972 | Wind | 206/45.34 |
| 3,776,375 | 12/1973 | Rohdin | 206/45.34 |
| 3,800,998 | 4/1974 | Gask | 229/2.5 |
| 3,955,745 | 5/1976 | Forrer | 229/40 |
| 3,955,748 | 5/1976 | Calvert | 229/40 |
| 3,963,170 | 6/1976 | Wood | 229/40 |
| 4,083,451 | 4/1978 | Hair | 206/461 |
| 4,210,246 | 7/1980 | Kuchenbecker | 206/461 |
| 4,266,666 | 5/1981 | Kuchenbecker | 206/461 |
| 4,300,682 | 11/1981 | Kuchenbecker | 206/461 |
| 4,466,534 | 8/1984 | Dunn | 206/45.34 |
| 4,485,920 | 12/1984 | Skyluik | 206/467 |
| 4,512,474 | 4/1985 | Harding | 206/470 |

FOREIGN PATENT DOCUMENTS

| | | | |
|---|---|---|---|
| 2029360 | 3/1980 | United Kingdom | 206/470 |

*Primary Examiner*—David T. Fidei

[57] ABSTRACT

A device for the convenient storage and shipment of conventional blister-pack articles comprises two sheets of material, optionally hinged in the middle, each sheet containing a plurality of openings therethrough. Each opening is configured so that one blister itself can pass easily through the opening, but the card to which the blister is attached cannot pass through the opening. Means are provided on each sheet to hold them closed together when the sheets are holding blister packs.

31 Claims, 2 Drawing Sheets

DEVICE FOR STORING AND SHIPPING BLISTER PACK ARTICLES

BACKGROUND OF THE INVENTION

The present invention relates to the storage and shipment of articles conventionally packaged and sold in blister packs. A "blister pack" refers to the conventional packaging arrangement including a card, usually formed of medium to heavy gauge cardboard, and a clear, rigid or moderately stiff plastic blister projecting from the plane of the card on one side of the card. The card from which the blister projects extends beyond the edge of the blister in length, width, or both, to provide space on which appropriate graphics can be printed which describe the product and its attributes. The blister itself can contain a single product item, such as a single package of a cosmetic, or can contain a plurality of items such as screws, nails, thumbtacks, and other such items conventionally sold in bulk quantities.

While blister pack items are a convenient method of displaying a product in a store, they present difficulties in shipment, and storage. These difficulties include the uneven geometric configuration and the uneven weight distribution, which prevent convenient stacking. In addition, the sheer number of such items in a given shipment leads to difficulties in counting the items; and if the items are packed loose in a carton for shipment there can be damage to the cards and the blisters. Thus, a need exists for a convenient way of holding a number of blister pack items in a manner in which they can easily and compactly be stored and shipped.

SUMMARY OF THE INVENTION

In one aspect, the device of the present invention comprises a pair of sheets having essentially the same outer dimensions, or a sheet of stiff material hinged in the center, and comprising a plurality of holes dimensioned so that the blister itself but not the card to which the blister is attached can pass freely through said holes, and further comprising means integral with said device for securing the opposed edges of the sheets to each other when the device is holding blister packs.

By "stiff" is meant that the material from which the sheet is formed is rigid or at least capable of standing on its own when the sheet is folded at an angle about its hinge.

In another aspect, the present invention comprises a package assembly comprising, in combination, the sheet of the present invention folded over on itself about the hinge, such that the two sections of the sheet are held to each other by the securing means, and further comprising a plurality of blister packs in back-to-back position relative to each other and held between the two halves of the sheet, wherein the blisters protrude through the openings in said sheet.

In yet another aspect, the present invention comprises a pair of sheets held to each other by the securing means, and further comprising a plurality of blister packs in back-to-back positions.

The device can further include holes through which price labels can be attached to each card of a blister pack.

DETAILED DESCRIPTION OF THE INVENTION

The present invention is useful, as indicated, for the convenient and compact storage and shipment of a plurality of blister packs. The device is capable of convenient and compact storage and reuse.

Figure 1:
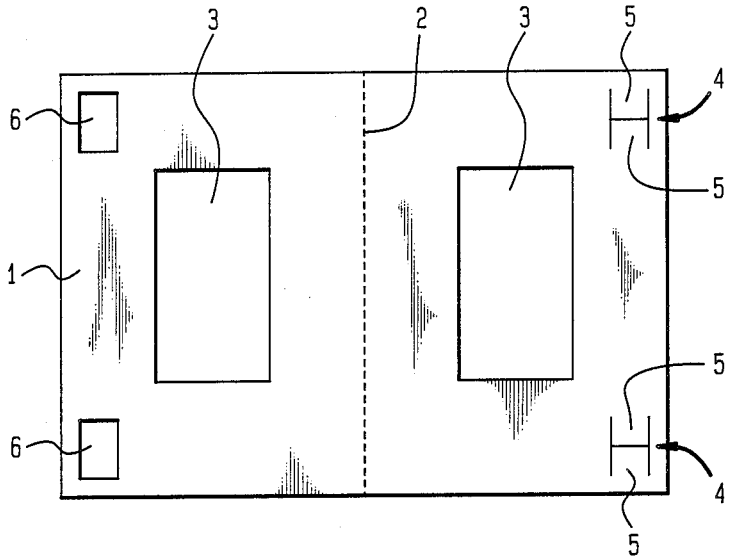
FIG. 1 is a front plan view of one embodiment of the packaging device of the present invention.

Turning first to FIG. 1, the packaging device of the present invention comprises a sheet 1 of material, which is preferably medium to heavy gauge cardboard. Sheet 1 can include a hinge 2, which can be simply a crease formed across the center of the sheet 1. Hinge 2 divides sheet 1 into two sections which are preferably of equal size. A plurality of openings 3 in the sheet are formed in sheet 1. The openings 3 can be symmetrically arranged on each side of hinge 2. While two openings 3 are depicted, there can be two, three or more openings on each side of hinge 2.

Sheet 1 also comprises integral fastening means for securing the two halves of sheet 1 together when the two halves are folded together about hinge 2. In the embodiment shown, the securing means includes a plurality of tab means 4 which can be formed by appropriate cuts into the sheet 1. Each tab means is formed by two vertical cuts and one horizontal cut, thereby forming two tabs 5 which can be bent out of the plane of sheet 1 when necessary. The securing means further comprises a plurality of openings 6 of a size and location so that the openings 6 registrably correspond with the tabs 5 when the two sections of sheet 1 are folded together about hinge 2. Thus, when the two halves are folded together the tabs 5 are bent out of the plane of sheet 1 and forced through the holes 6 thereby forming a releasable fricition lock which holds the two halves of sheet 1 together. The tabs 5 should be of the same width as the holes 6 or can be slightly wider to improve the friction. The tab means 4 and holes 6 are preferably located adjacent to the edge of the respective sections of sheet 1, between the openings 3 and the edge. Another embodiment of the present invention comprises two sheets of the type depicted in FIG. 1 and described herein, without the hinge 2. In this embodiment, to hold blister packs one attaches two sheets 1 to each other using means 4 and respective openings 6.

It will be appreciated that the size of sheet 1, and of the openings 3, can vary depending on the size of the blister packs and the associated cards which one desires to package within the packaging device of the present invention. Preferably, the height and width of sheet 1 are sufficient (whether or not the sheet is hinged) so that no part of the card attached to a blister protruding through an opening 3 extends beyond any edge of sheet 1. This feature protects the card from unnecessary damage during handling. In addition, where two or more openings 3 are provided on the same side of a hinge 2, they should be spaced far enough apart so that blister packs can be placed side by side with the blisters protruding through their respective openings 3 without a blister being impeded by the card of an adjacent blister pack. It is permissible for cards of adjacent blister packs to overlap each other, provided that the hinge 2 is not covered and provided that the cards do not impede passage of adjacent blisters through their respective openings. As indicated above, it is necessary that the opening 3 be large enough to fully accommodate the blister itself, but smaller than the card to which the blister is attached.

Figure 2:
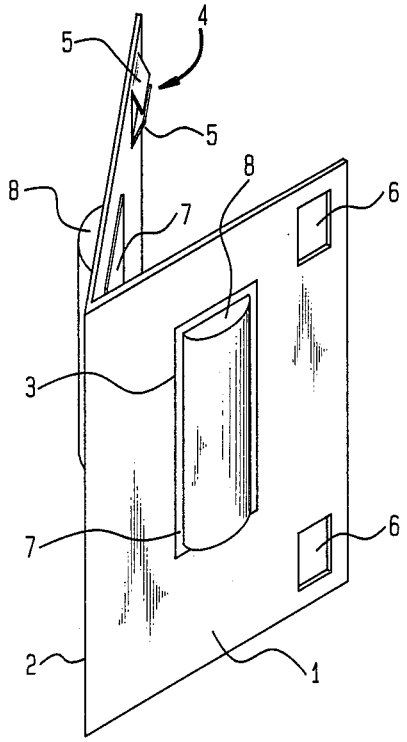
FIG. 2 is a perspective view of the packaging device of FIG. 1 together with blister packs.
Figure 3:
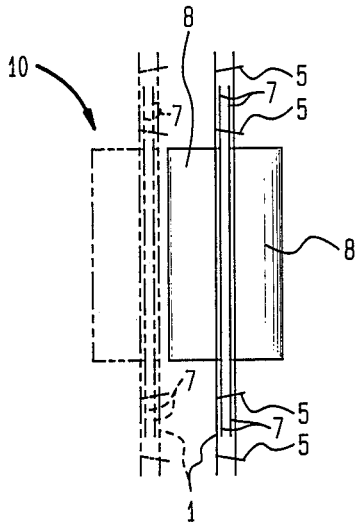
FIG. 3 is a perspective view of the packaging device of FIG. 1 in its closed form carrying a plurality of blister pack items.

To use the device in the present invention one simply selects a sheet 1 having the necessary dimensions as dictated by the size and shape of the blister and card associated with the blister pack to be packaged. Then, a number of blister packs equal to the number of openings 3 in the sheet 1 are selected and placed such that each blister extends through one of the openings 3 in the selected sheet. As seen in FIG. 2, all blister packs to be held by a given sheet 1 are positioned with cards 7 on the same side of sheet 1 and blisters 8 protruding through the respective openings. Sheet 1 if folded in half along hinge 2. This folding brings the cards 7 of the blister packs on opposite sides of hinge 2 into back-to-back contact with each other. This folding also brings the holes 6 into registration with the means 4. The final step is to force the tabs 5 of means 4 through the corresponding holes 6, as seen in FIG. 3, thereby fastening the two halves of sheet 1 to each other in a sturdy manner which can nonetheless be readily unfastened when the package reaches the destination at which the blister packs will eventually be removed.

Alternatively, two sheets 1 having essentially the same dimensions and configuration are selected and blister packs are placed with their blisters protruding through the openings, wherein all the cards are on the same side of each sheet. Then, the sheets are brought together with the cards in back-to-back relation, and the sheets are fastened to each other using means 4, 5 and 6.

Figure 4:
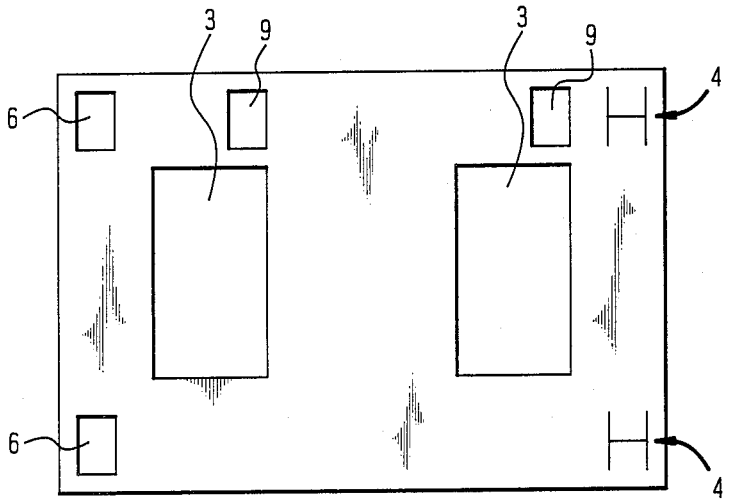
FIG. 4 is a front plan view of another embodiment of the present invention.

Referring to FIG. 4, the sheet 1 can be provided with additional openings 9 located so that a portion of each card of a blister pack held in the device can be seen through the opening 9. When the blister packs are packaged as described above part of the front of the card (that is, the side which will be visible to a prospective customer) will be visible through opening 9. It is a simple matter to attach conventional price labels, such as those of the type having a gummed back, to each card through the openings 9. This is much easier and faster than attaching such labels to each card after the blister packs have been removed from the packaging device 1.

The device of the present invention provides numerous significant advantages. Among them are the light weight, low cost and simple storage of the sheet itself, and the ease and rapidity with which blister pack items can be packaged into the device. Packages comprising the device folded and locked around a plurality of blister packs are also highly advantageous. They can be easily packed into cartons for shipment; packing is facilitated in that the blisters protruding from adjacent packages interfit with each other so that adjacent packages are separated by the thickness of one blister (see FIG. 3 in which a second device 10 is shown in phantom). Packaging and handling are also facilitated because the packages have an even weight distribution so they are less likely to tip over when being handled. Labeling or price tags can conveniently be attached to the outside of the sheet, and the contents of the blisters remain visible. In addition, the task of counting the number of blister packs in a shipment is eased because one needs only to count the number of assembled packages.

What is claimed is:

1. In combination, a plurality of blister packages, each of said blister packages comprising a first member contoured so as to receive an article and a second member attached to said first member so as to form a substantially enclosed receptacle for the article; and a device adapted to hold said blister packages, said device comprising a first sheet made from a relatively stiff material and having a first substantially planar surface on one side of said first sheet and a second substantially planar surface on an opposite side of said first sheet, a second sheet made from a relatively stiff material and having a first substantially planar surface on one side of said second sheet and a second substantially planar surface on an opposite side of said second sheet, receiving means for removably receiving said first members of said blister packages, said receiving means including a plurality of openings formed in at least one of said first and second sheets, each of said openings being sized and shaped so as to receive said first member of a corresponding one of said blister packages, and attaching means for attaching said first and second sheets to each other without attaching said blister packages to either of said first and second sheets, said first and second sheets being attached to each other such that said first surfaces thereof are arranged face-to-face so as to loosely hold said blister packages between said first and second sheets in such a manner that said first member of each of said blister packages protrudes outwardly beyond one of said second surfaces and in such a manner that a marginal portion of each of said blister packages is in abutting relationship with one of said first surfaces, whereby said blister packages are inhibited from inadvertently passing through said openings.

2. The combination of claim 1, wherein said receiving means includes a first set of said openings in said first sheet and a second set of said openings in said second sheet, whereby said first members of said blister packages protrude from opposite sides of said device.

3. The combination of claim 1, wherein said attaching means includes a plurality of holes extending through said first sheet from said first surface thereof to said second surface thereof and a plurality of tabs provided on said second sheet, each of said tabs being aligned with a corresponding one of said holes and extending through said corresponding one of said holes so as to releasably engaged said first sheet.

4. The combination of claim 3, wherein said attaching means further includes hinging means for hinging said first and said second sheets to each other.

5. The combination of claim 4, wherein said first and second sheets are formed from a single piece of substantially stiff material and said hinging means includes a crease line separating said first sheet from said second sheet.

6. The combination of claim 3, wherein said first and second sheets are mafde from separate pieces of substantially stiff material.

7. The combination of claim 1, wherein said device further comprises a plurality of holes formed in said at least one of said first and second sheets, each of said holes being aligned with a predetermined area on a corresponding one of said blister packages and being sized and shaped so as to permit a price label to pass therethrough during its application to said predetermined area on said corresponding one of said blister packages, whereby price labels can be applied to said blister packages while said blister packages are held in said device.

8. The combination of claim 1, wherein said second member is a card having a predetermined height and width and said first member includes a blister extending from one side of said card, the junction between said blister and said card forming a predetermined geometric configuration.

9. In combination, a plurality of blister packages, each of said blister packages comprising a first member contoured so as to receive an article and a second member attached to said first member so as to form a substantially enclosed receptacle for the article; and a device adapted to hold said blister packages, said device comprising a first sheet made from a relatively rigid material and having a first substantially planar surface on one side of said first sheet, a second substantially planar surface on an opposite side of said first sheet and an opening extending through said first sheet from said first surface thereof to said second surface thereof, said opening in said first sheet being sized and shaped so as to removably receive said first member of a first blister package, a seocnd sheet made from a relatively stiff material and having a first substantially planar surface on one side of said second sheet, a second substantially planar surface on an opposite side of said second sheet and an opening extending through said second sheet from said first surface thereof to said second surface thereof, said opening in said second sheet being sized and shaped so as to removably receive said first member of a second blister package, and attaching means for attaching said first and second sheets to each other without attaching said first and second blister packages to either of said first and second sheets, said first and second sheets being attached to each other such that said first surfaces thereof are arranged face-to-face so as to loosely hold said first and second blister packages between said first and second sheets in such a manner that said first member of said first blister package protrudes outwardly beyond said second surface of said first sheet through said opening in said first sheet and said first member of said second blister package protrudes outwardly beyond said second surface of said second sheet through said opening in said second sheet, whereby said first and second blister packages extend outwardly from opposite sides of said device, and in such a manner that a marginal portion of said first blister package is in abutting relationship with said first surface of said first sheet and a marginal portion of said second blister package is in abutting relationship with said first surface of said second sheet, whereby said first and second blister packages are inhibited from inadvertently passing through said openings in said first and second sheets, respectively.

10. The combination of claim 9, wherein said first sheet includes another opening extending from said first surface of said first sheet to said second surface of said first sheet, said another opening in said first sheet being sized and shaped so as to removably receive said first member of a third blister package, whereby said first sheet removably receives a plurality of said blister packages, and said second sheet includes another opening extending from said first surface of said second sheet to said second surface of said second sheet, said another opening in said second sheet being sized and shaped so as to removably receive said first member of a fourth blister package, whereby said second sheet removably receives a plurality of said blister packages.

11. The combination of claim 10, wherein said attaching means includes a plurality of holes extending through said first sheet from said first surface thereof to said second surface thereof and a plurality of tabs provided on said second sheet, each of said tabs being aligned with a corresponding one of said holes and extending through said corresponding one of said holes so as to releasably engage said first sheet.

12. The combination of claim 11, wherein said attaching means further includes hinging means for hinging said first and said second sheets to each other.

13. The combination of claim 12, wherein said first and second sheets are formed from a single piece of substantially stiff material and said hinging means includes a crease line separating said first sheet from said second sheet.

14. The combination of claim 11, wherein said first and second sheets are made from separate pieces of substantially stiff material.

15. The combination of claim 9, wherein said device further comprises a first hole formed in said first sheet, said first hole being aligned with a predetermined area on said first blister package and being sized and shaped so as to permit a price label to pass therethrough during its application to said predetermined area on said first blister package, whereby a price label can be applied to said first blister package while said first blister package is held in said device, and a second hole formed in said second sheet, said second hole being aligned with a predetermined area on said second blister package and being sized and shaped so as to permit a price label to pass therethrough during its application to said predetermined area on said second blister package, whereby a price label can be applied to said second blister package while said second blister package is held in said device.

16. The combination of claim 9, wherein said second member is a card having a predetermined height and width and said first member includes a blister extending from one of said card, the junction between said blister and said card forming a predetermined geometric configuration.

17. In combination, a plurality of blister packages, each of said blister packages comprising a first member contoured so as to receive an article and a second member attached to said first member so as to form a substantially enclosed receptacle for the article; and a plurality of devices adapted to hold said blister packages, each of said devices comprising a first sheet made from a relatively stiff material and having a first substantially planar surface on one side of said first sheet and a second substantially planar surface on an opposite side of said first sheet, a second sheet made from a relatively stiff material and having a first substantially planar surface on one side of said second sheet and a second substantially planar surface on an opposite side of said second sheet, receiving means for removably receiving said first members of some of said blister packages, said receiving means including a plurality of openings formed in at least one of said first and second sheets, each of said openings being sized and shaped so as to receive said first member of a corresponding one of said blister packages, and attaching means for attaching said first and second sheets to each other without attaching said some of said blister packages to either of said first and second sheets, said first and second sheets being attached to each other such that said first surfaces thereof are arranged face-to-face so as to loosely hold said some of said blister packages between said first and second sheets in such a manner that said first member of each of said some of said blister packages protrudes outwardly beyond one of said second surfaces and in such a manner that a marginal portion of each of said some of said blister packages is in abutting relationship with one of said first surfaces, whereby said some of said blister packages are inhibited from inadvertently passing through said openings, and said devices being arranged adjacent to each other such that said first members of said blister packages which are held by one of said devices interfit with said first members of said blister packages which are held by another of said devices, said another device being adjacent to said one device, whereby said combination forms a convenient storage and shipment system.

18. The combination of claim 17, wherein said receiving means of each of said devices includes a first set of said openings in said first sheet and a second set of said openings in said second sheet, whereby said first members of said blister packages protrude from opposite sides of each of said devices.

19. The combination of claim 17, wherein said attaching means of each of said devices includes a plurality of holes extending through said first sheet from said first surface thereof to said second surface thereof and a plurality of tabs provided on said second sheet, eachof said tabs being aligned with a corresponding one of said holes and extending through said corresponding one of said holes so as to releasably engage said first sheet.

20. The combination of claim 19, wherein said attaching means of each of said devices further includes hinging means for hinging said first and said second sheets to each other.

21. The combination of claim 20, wherein said first and second sheets of each of said devices are formed from a single piece of substantially stiff material and said hinging means of each of said devices includes a crease line separating said first sheet from said second sheet.

22. The combination of claim 19, wherein said first and second sheets of each of said devices are made from separate pieces of substantially stiff material.

23. The combination of claim 17, wherein each of said devices further comprises a plurality of holes formed in said at least one of said first and second sheets, each of said holes being aligned with a predetermined area on a corresponding one of said blister packages and being sized and shaped so as to permit a price label to pass therethrough during its application to said predetermined area on said corresponding one of said blister packages.

24. The combination of claim 17, wherein said second member of each of said blister packages is a card having a predetermined height and width and said first member of each of said blister packages includes a blister extending from one side of said card, the junction between said blister and said card forming a predetermined geometric configuration.

25. In combination, a plurality of blister packages, each of said blister packages comprising a first member contoured so as to receive an article and a second member attached to said first member so as to form a substantially enclosed receptacle for the article; and a plurality of devices adapted to hold said blister packages, each of said devices comprising a first sheet made from a relatively rigid material and having a first substantially planar surface on one side of said first sheet, a second substantially planar surface on an opposite side of said first sheet and a first set of openings extending through said first sheet from said first surface thereof to said second surface thereof, each opening of said first set of openings being sized and shaped so as to removably receive said first member of a corresponding one of said blister packages, whereby said first sheet removably receives a first set of blister packages, a second sheet made from a relative stiff material and having a first substantially planar surface on one side of said second sheet, a second substantially planar surface on an opposite side of said second sheet and a second set of openings extending through said second sheet from said first surface thereof to said second surface thereof, each opening of said second set of openings being sized and shaped so as to removably receive said first member of a corresponding one of said blister packages, whereby said second sheet removably receives a second set of blister packages, and attaching means for attaching said first and second sheets to each other without attaching said blister packages of said first and second sets of blister packages to either of said first and second sheets, said first and second sheets being attached to each other such that said first surfaces thereof are arranged face-to-face so as to loosely hold said blister packages of said first and second sets of blister packages between said first and second sheets in such a manner that said first members of said blister packages of said first set of blister packages protrude outwardly beyond said second surface of said first sheet through said openings of said first set of openings and said first members of said blister packages of said second set of blister packages protrude outwardly beyond said second surface of said second sheet through said openings of said second set of openings, whereby said first members of said first set of blister packages protrude in an opposite direction from said first members of said second set of blister packages, and in such a manner that a marginal portion of each blister package of said first set of blister packages is in abutting relationship with said first surface of said first sheet and a marginal portion of each blister package of said second set of blister packages is in abutting relationship with said first surface of said second sheet, whereby said blister packages of said first set of blister packages are inhibited from inadvertently passing through said openings of said first set of openings and said blister packages of said second set of blister packages are inhibited from inadvertently passing through said openings of said second set of openings, and said devices being arranged adjacent to each of other such that said first members of said blister packages of said first set of blister packages of one of said devices interfit with said first members of said blister packages of said second set of blister packages of another of said devices, said another device being adjacent to said one device, whereby said combination forms a convenient storage and shipment system.

26. The combination of claim 25, wherein said attaching means of each of said devices includes a plurality of holes extending through said first sheet from said first surface thereof to said second surface thereof and a plurality of tabs provided on said second sheet, each of said tabs being aligned with a corresponding one of said holes and extending through said corresponding one of said holes so as to releasably engage said first sheet.

27. The combination of claim 26, wherein said attaching means of each of said devices further includes hinging means for hinging said first and said second sheets to each other.

28. The combination of claim 27, wherein said first and second sheets of each of said devices are formed from a single piece of substantially stiff material and said hinging means of each of said devices includes a crease line separating said first sheet from said second sheet.

29. The combination of claim 26, wherein said first and second sheets of each of said devices are made from separate pieces of substantially stiff material.

30. The combination of claim 25, wherein each of said devices further comprises a first set of holes formed in said first sheet, eachof said holes of said first set of holes being aligned with a predetermined area on a corresponding one of said blister packages of said first set of blister packages and being sized and shaped so as to permit a price label to pass therethrough during its application to said predetermined area on said corresponding one of said blister packages of said first set of blister packages, and a second set of holes formed in said second sheet, each of said holes of said second set of holes being aligned with a predetermined area on a corresponding one of said blister packages of said second set of blister packages and being sized and shaped so as to permit a price label to pass therethrough during its application to said predetermined area on said corresponding one of said blister packages of said second set of blister packages.

31. The combination of claim 25, wherein said second member of each of said blister packages is a card having a predetermined height and width and said first member of each of said blister packages includes a blister extending from one side of said card, the junction between said blister and said card forming a predetermined geometric configuration.

* * * * *